US005172431A

United States Patent [19]

Rohde

[11] Patent Number: 5,172,431

[45] Date of Patent: Dec. 22, 1992

[54] REPLACEABLE TOILET SEAT COVER

[76] Inventor: Glenn L. Rohde, Rte. 2, Box 18, Echo, Oreg. 97826

[21] Appl. No.: 640,091

[22] Filed: Jan. 11, 1991

[51] Int. Cl.[5] ..... A47K 13/14

[52] U.S. Cl. ..... 4/245.001; 4/245.003

[58] Field of Search ..... 4/242, 243, 244, 245, 4/246, 247, 245.1, 245.3, 245.5, 245.7, 245.6

[56] References Cited

U.S. PATENT DOCUMENTS

| | | | |
|---|---|---|---|
| 966,838 | 9/1910 | Jaffee et al. | 4/243 |
| 1,081,091 | 12/1913 | Camelo | 4/243 |
| 1,186,556 | 6/1916 | Diggle | 4/245 |
| 2,286,632 | 6/1942 | Manville | 4/242 |
| 3,263,241 | 8/1966 | Sualson | 4/457 |
| 4,106,135 | 8/1978 | Mannheim | 4/247 |
| 4,213,212 | 7/1980 | Hefty et al. | 4/243 |
| 4,760,613 | 8/1988 | Bobak | 4/247 |
| 4,766,618 | 8/1988 | Boker | 4/247 |
| 4,806,406 | 2/1989 | Akerman et al. | 4/242 |
| 4,850,061 | 7/1989 | Engel | 4/243 |
| 4,910,809 | 3/1990 | Boker | 4/247 |
| 4,920,584 | 5/1990 | Abdrabbo | 4/242 |
| 4,926,506 | 5/1990 | Wang | 4/247 |

FOREIGN PATENT DOCUMENTS

| | | | |
|---|---|---|---|
| 562024 | 5/1975 | Switzerland | 4/242 |
| 2049758 | 12/1980 | United Kingdom | 4/242 |

*Primary Examiner*—Henry J. Recla
*Assistant Examiner*—David J. Walczak
*Attorney, Agent, or Firm*—Kolisch, Hartwell, Dickinson, McCormack & Heuser

[57] ABSTRACT

A resilient, replaceable toilet seat cover is provided which conforms generally to the shape of a toilet seat. The body of the toilet seat cover is a molded plastic or a suitable formable paper product which is semi-rigid and retains its shape. In one preferred embodiment, the toilet seat cover is vacuum-molded from a thin sheet of deformable, resilient plastic. Another embodiment of the toilet seat cover includes a removable, thin protective film which can be peeled off to ensure that a new, clean cover has been provided, and to prevent reuse of the cover. Several other alternative embodiments of the invention include various attaching devices to lock the cover onto the toilet seat. The cover is particularly suitable for use in motels or the like where a guest is provided with private bathroom facilities and desires assurance of a sanitized toilet seat surface without the inconvenience of single-use disposable covers.

11 Claims, 4 Drawing Sheets

REPLACEABLE TOILET SEAT COVER

BACKGROUND OF THE INVENTION

The invention relates generally to hygienic covers for toilet seats and more particularly to a generally semi-rigid, replaceable cover which conforms in shape to the top surface of a toilet seat.

Replaceable covers for toilet seats have heretofore included paper or plastic devices designed to be discarded after a single use. Such disposable covers are usually effective for hygienic purposes in public restrooms, where each user will discard the cover after a single use. Such disposable covers are less desirable in situations where a user stays for a time in lodgings such as a motel, hotel or as a guest in the room of a private home. For someone residing in temporary lodgings, single-use disposable toilet seat covers often are inconvenient and wasteful. For example, someone staying for a short time in a motel or private home, with exclusive access to a private bathroom, might want the hygienic security of a personal toilet seat cover but would find it inconvenient to have to position a disposable cover on the toilet seat repeatedly during their stay.

It would be advantageous to be able to provide a replaceable toilet seat cover which, upon installation, provides assurance of a hygienic toilet seat provided for the user's exclusive, temporary, personal use, but which is not intended for disposal after each use. It would also be advantageous to provide such a replaceable toilet seat cover which is semi-rigid and can snap over the toilet seat and remain in place.

It is an object of the present invention to provide a semi-rigid, replaceable toilet seat cover formed from a sheet of thin, moldable or formable material designed to provide a hygienic toilet seat surface for guests.

Another object of the invention is to provide a replaceable toilet seat cover with a protective film covering on its surface for the user to peel off before using the toilet 10 seat, ensuring that a fresh seat cover is being used.

Still another object of the invention is to provide replaceable toilet seat covers formed of a semi-rigid, resilient material which is sufficiently resiliently deformable to permit a plurality of the toilet seat covers to stack together in nested fashion to facilitate storage and dispensing of the covers, and to help in the storage and recovery of used covers.

Accordingly, a replaceable toilet seat cover is provided comprising a semi-rigid body formed of a sheet of thin moldable resilient material shaped to cover the top of a toilet seat. The body of resilient material extends generally around a central opening along the top of the toilet seat and has depending sides extending along portions of the sides of the toilet seat. Engaging surfaces are provided on the depending sides for engaging the toilet seat to retain the body of the cover on the toilet seat.

The toilet seat cover preferably includes a broad, elongate expanse of resilient material which extends around the central opening to form part of the top surface of the cover. One of the depending sides is an inner side which curves inwardly and downwardly from the top surface into the central opening. The other of the depending sides is an outer side which curves outwardly and downwardly from the top surface. The inner and outer sides generally conform in shape to the inner and outer sides of a toilet seat. The top surface and sides of the cover define an elongate concave channel on the underside of the cover, between the inner and outer sides. A toilet seat fits in the channel. At the terminal edge of each side of the toilet seat cover are inner and outer edges along which engaging surfaces extend. The engaging surfaces are preferably each in the form of a bead of moldable resilient material which engages the underside of a toilet seat.

Yet another preferred embodiment of the invention includes provision for a protective, removable film of flexible sheet material which can be removed from the cover to ensure that the cover is fresh and sanitary and was not previously used. A tear-off barrier extending across the central opening of the toilet seat cover can also be provided to ensure that the cover has not been previously used.

DETAILED DESCRIPTION OF THE PREFERRED EMBODIMENT

Figure 1:
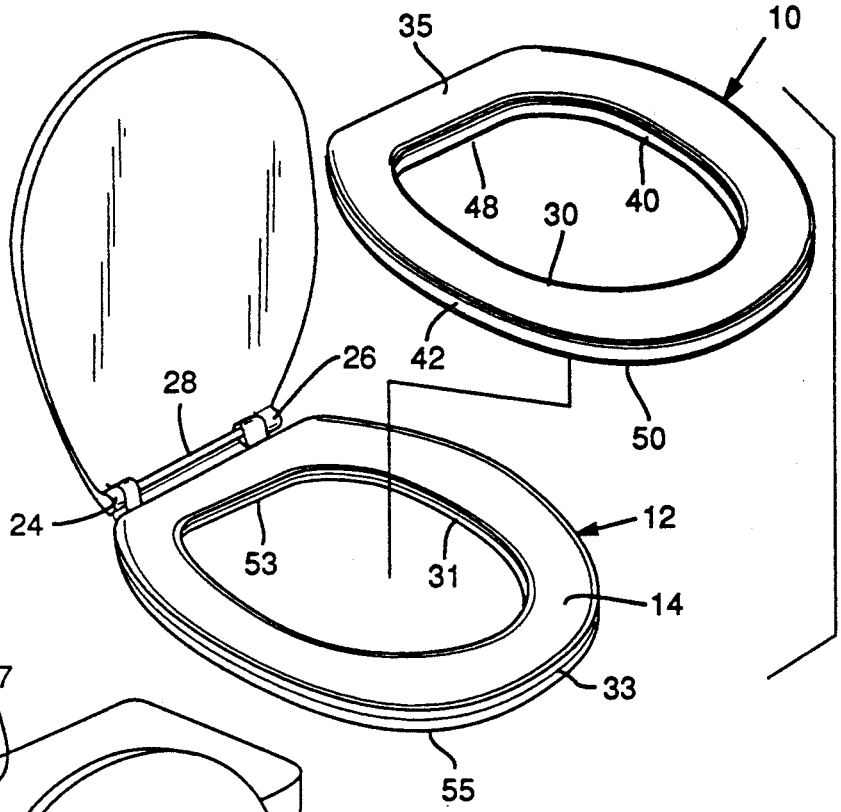
FIG. 1 is a perspective view of a replaceable toilet seat cover, in accordance with the present invention, positioned above a representative toilet seat.
Figure 2:
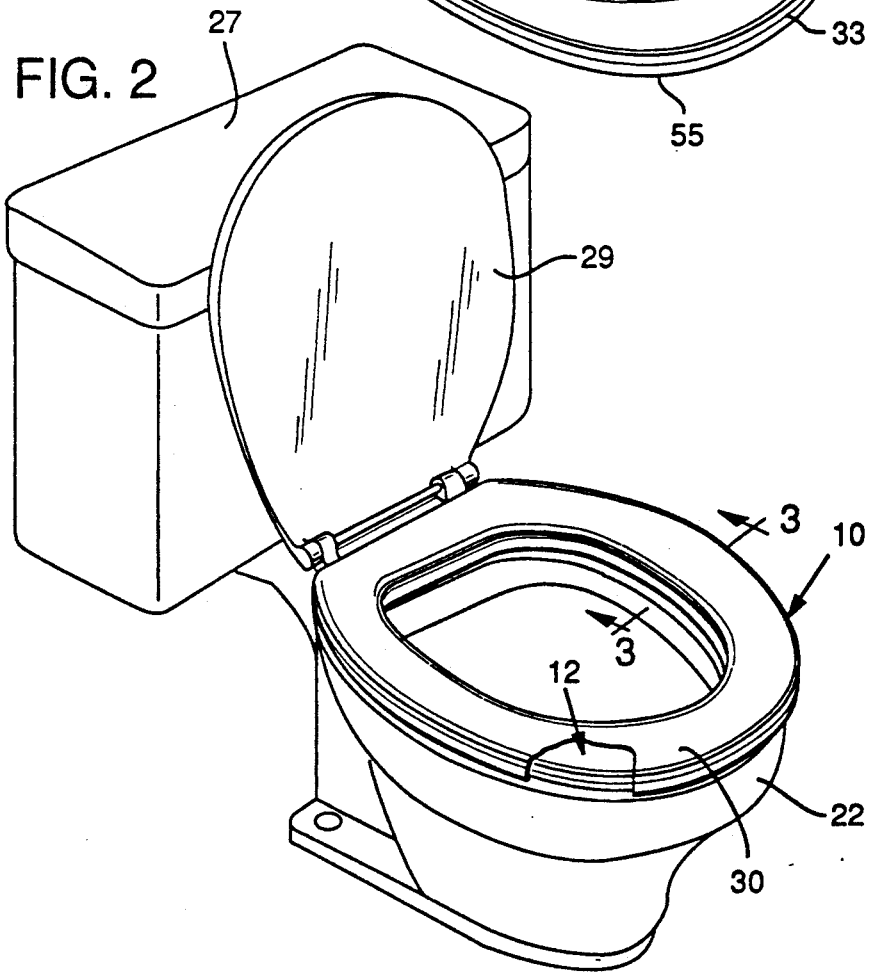
FIG. 2 is a partial, perspective view of the replaceable toilet seat cover shown in FIG. 1, partially cut away, in place on the toilet seat.

Referring to FIGS. 1 and 2, a first embodiment of a replaceable toilet seat cover 10 is shown, in accordance with the present invention, positioned above a conventional, generally oval-shaped, toilet seat 12. FIG. 1 shows the toilet seat cover prior to its installation on toilet seat 12 and FIG. 2 shows the cover in place on the toilet seat. The toilet seat 12 is of any conventional type, such as wood, plastic or plastic laminated over a fibrous wood or pressed-wood core. Shown in Cross-section in FIG. 3, the toilet seat 12 includes a curved or contoured top surface 14 and a generally flat bottom surface 16. Legs or bumper pads 18 are attached to the bottom surface 16 and rest against the top 20 of the toilet bowl 22. A pair of hinges 24, 26 attach to the back side of toilet seat 28, where the seat is hingedly attached to the toilet 27. The hinges 24, 26 allow the . seat to be pivoted upwardly and downwardly relative to the toilet bowl 22. A hinged lid 29 is sometimes provided to close the toilet bowl and is compatible with use of the cover of the present invention.

Replaceable toilet seat cover 10 is shaped to generally conform to the top 14 of seat 12. Toilet seat cover 10 includes a body 30 formed of a sheet of thin moldable resilient material of a type which can be formed into a semi-rigid article by conventional molding techniques. Suitable materials for the body of cover 10 include, for example, polyethylene, polypropylene, or a moldable paper product such as pressed cardboard or the like. The moldable resilient sheet material preferably has a thickness in the range of between about 10-mils and 20-mils, resulting in a semi-rigid structure, which holds its shape but is flexible or resiliently bendable.

Cover 10 is shaped to conform to the contoured top 14 of toilet seat 12, which includes a broad, generally flat, seating surface and inside and outside generally oval-shaped sidewalls 31, 33 which complete top surface 14 (see FIG. 1). Cover 10 is not intended to cover the generally flat underside 16 of toilet seat 12, except to engage the underside at its margins to retain the cover on the seat, as described below.

Figure 3:
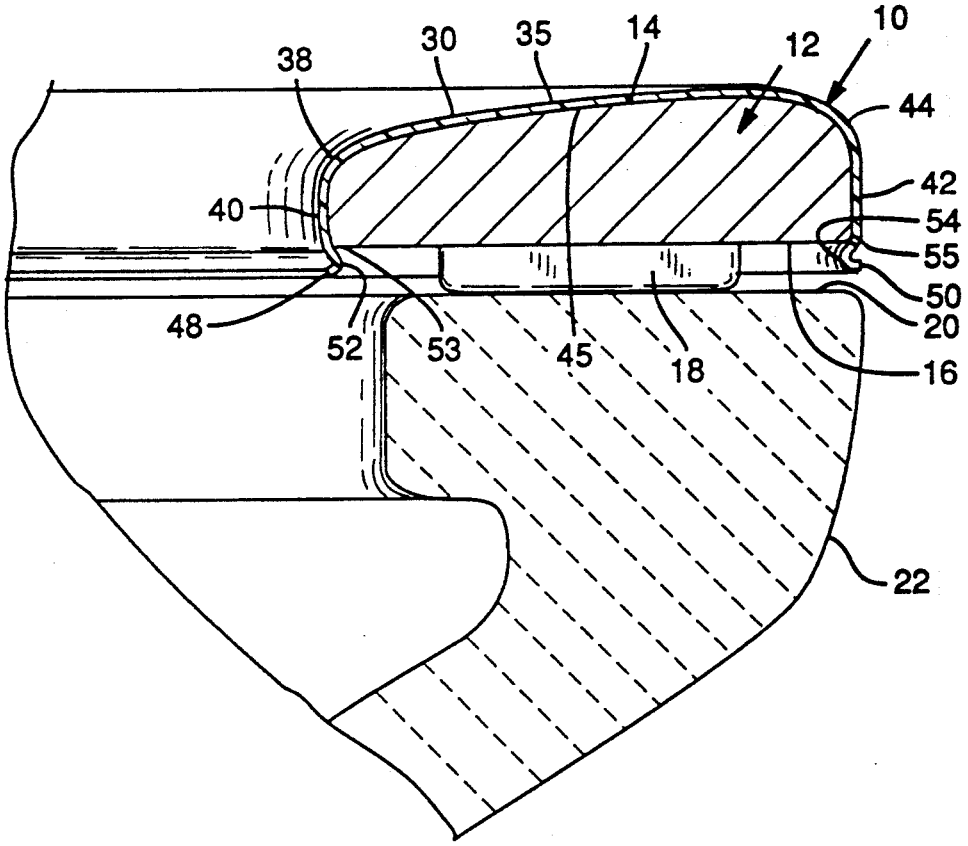
FIG. 3 is a partial, cross-sectional view, on an enlarged scale, of a toilet seat and cover taken along line 3—3 of FIG. 2.

FIG. 3 shows the body 30 of cover 10 in cross-section, together with seat 12. The cover includes a broad, elongate expanse 35 of resilient sheet material along the generally horizontal top of the cover, extending around a central opening 32. Elongate top 35 overlies the broad seating surface of seat 14. Depending sides 40, 42 extend continuously along and adjacent the sides 31, 33 of seat 12. Side 40, adjacent central opening 32, is referred to as the inner side of the cover. It curves inwardly and downwardly from the broad, generally flat central portion of the cover 35 through a curved, transitional "corner" 38. The outer side 42 curves outwardly and downwardly from the flat central top 35 through curved transitional "corner" 44. Sides 40, 42 depend from the top 35 of cover 10, extending downwardly relative to top 35. Top surface 35 and sides 40, 42 define and enclose an elongate, concave channel 45 on the underside of cover 10 between the inner and outer sides. Toilet seat 12 fits into channel 45, which is also referred to as a generally oval-shaped concavity.

Inner depending side wall 40 terminates at inner edge 48 and outer depending side wall 42 terminates at outer edge 50. Cover 10 includes engaging surfaces on sides 40, 42 adjacent edges 48, 50, respectively, for engaging the toilet seat 12 in order to retain the cover on the toilet seat. In the preferred embodiment, the seat-engaging surface on each inner and outer side wall is a bead of the resilient sheet material from which cover 10 is fabricated. The beads extend slightly under the underside 16 of the toilet seat at the inner and outer edges. Inner bead 52 extends continuously adjacent inner edge 48 and outer bead 54 extends continuously adjacent outer edge 50. Beads 52, 54 extend or face toward one another across channel 45, extending slightly into the concavity 36 on the underside of the cover. Beads 52, 54 are formed by conventional thermoplastic fabrication techniques such as, for example, heating the vacuum formed covers as part of the process of trimming excess sheet material from the margins of the cover. Beads 50 52 shown in FIG. 3 are elongate small-diameter bends or creases in the sheet material, formed just above lower edges 48, 50, respectively. Alternatively, beads 52, 54 could be elongated linear filaments of thickened sheet material or another material bonded or molded to the lower edges of the cover.

Cover body 30 is sufficiently resilient to permit the cover to flex as it is installed on and removed from toilet seat 12. While pressing a cover onto a toilet seat, side walls 40, 42 flex outwardly and the seat-engaging beads 52, 54 pass around the sidewalls 31, 33 of the toilet seat. When the beads engage the inner and outer edges 53, 55 of the underside 16 of the seat (FIG. 3), the cover snaps into place. Removal requires only a slight bending of the side walls away from the seat to allow a portion of the edge-engaging beads to break free, after which the cover can be lifted off.

Figure 4:
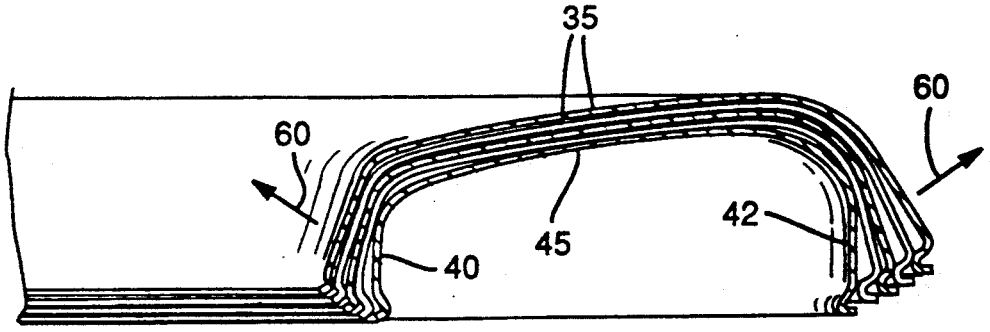
FIG. 4 is a partial, cross-sectional view of a plurality of toilet seat covers such as the one shown in FIG. 3, illustrating how multiple covers stack together in nested fashion.

The toilet seat cover 10 is also sufficiently flexible to permit a plurality of covers to be stacked together in nested fashion, as shown in FIG. 4. Inner and outer sides 40, 42, respectively are sufficiently deformable outwardly away from one another, in the direction of arrows 60, to permit a plurality of the cover bodies to stack together with the top surface 35 of one cover nested into the concave underside 45 of an adjacent cover. The sides 40, 42 will also squeeze inwardly to accommodate additional nested covers. This allows a plurality of covers to be stored and carried in a compact configuration. It also allows for relatively compact dispensers to be mounted, for example, on the wall above a toilet, to disperse the covers. In addition, nested storage of covers after use will allow for compact storage, encouraging proper disposal and recycling.

Figure 5:
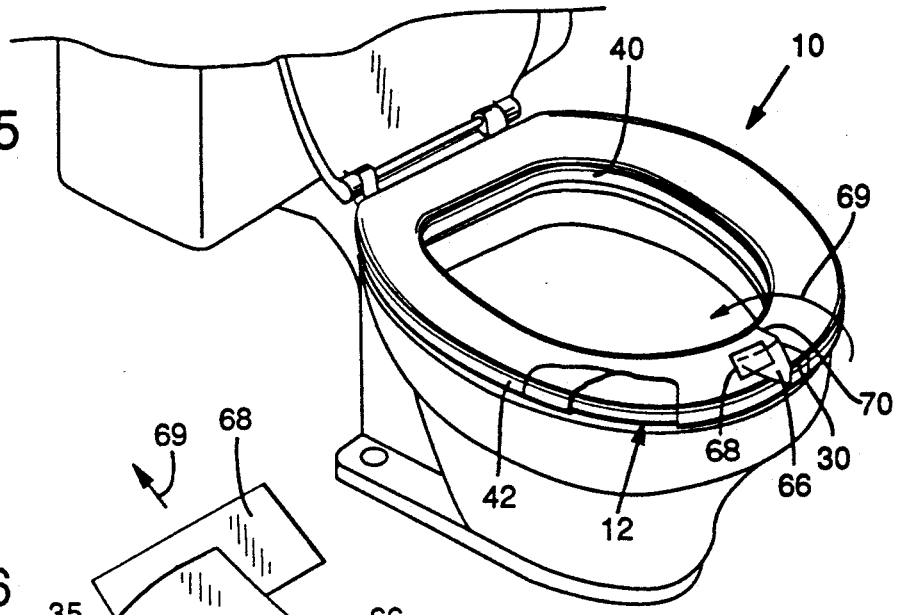
FIG. 5 is a partial, cross-sectional view of a removable toilet seat cover as in FIGS. 1 and 2, including a protective film of flexible sheet material covering the top surface of the toilet seat cover, showing how the film is removed using a pull tab.
Figure 6:
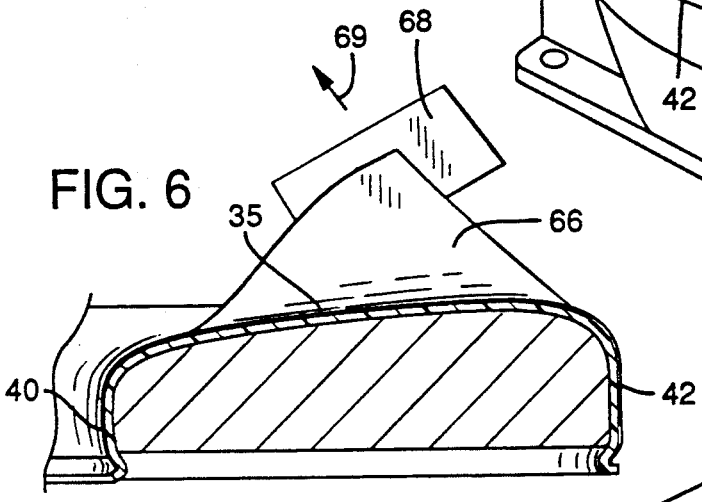
FIG. 6 is a cross-sectional view as in FIG. 3, on an enlarged scale, taken along line 6—6 of FIG. 5, further illustrating the removal of the thin protective film by means of a pull tab.

FIGS. 5 and 6 show an embodiment of the protective cover 10 which additionally includes a protective film on the outside surface of the body 30. The film 66 covers the outer surface areas of the top 35 and sides 40, 42 of the invention. The cover in the embodiment of FIGS. 5, 6 is exactly like the first embodiment cover of FIGS. 1-3 except for the additional provision of the thin film or membrane of flexible sheet material 66 on the outside surface. Thin film 66 can be cellophane or a similar clinging plastic wrap-type material, having a thickness in the range of between about 0.5-mils and 6-mils. Such thin sheet material does not retain an independent shape and will conform to the shape of the body of the toilet seat cover. Commercially available thermoplastic sheet material used in the fabrication of vacuum-formed articles is available with protective film 66 in place on one surface, if desired. Consequently, there is no need to install protective film 66 after fabrication of the toilet seat cover. Instead, the cover can be fabricated with the protective film already in place and the film will be shaped and trimmed together with the cover during fabrication.

To facilitate removal of the protective film 66 from the top and sides of the toilet seat cover, one or more adhesive tabs 68 are provided. A break or cut 70 in the film, as shown at the front of the toilet in FIG. 5, serves as a location to start peeling the film away from the cover. By grasping tab 68 and pulling upwardly and along the seat, as shown by arrows 69, the film is peeled away from the cover until the entire protective film has been removed. Several additional breaks in the film, with tabs installed adjacent each break, can be provided as needed to conveniently remove the protective film.

One function of protective film 66 is to allow the user to ensure that he or she is using a fresh toilet seat cover which has not been previously used. By removing the protective film, the user lets any potential subsequent users know that the protective cover was previously used. On the other hand, an intact protective film will indicate an unused cover. Removal of the film will also expose a fresh, sanitary surface which has not been exposed previously to the air.

Figure 7:
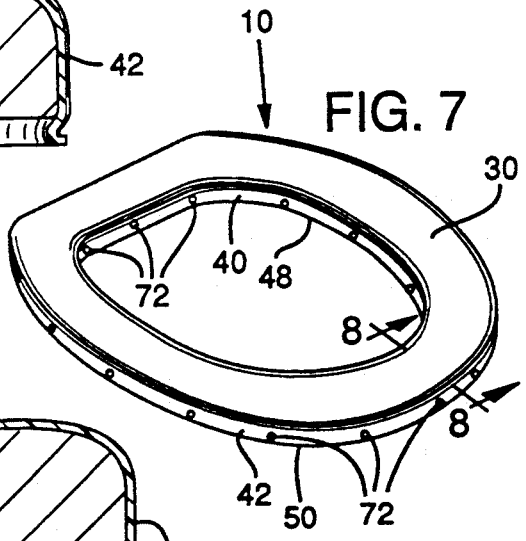
FIG. 7 is a perspective view as in FIGS. 1 and 2 showing an alternative embodiment of the engaging surfaces on the sides of the cover in the form of a plurality of protuberances extending around the inner and outer sides of the cover.
Figure 8:
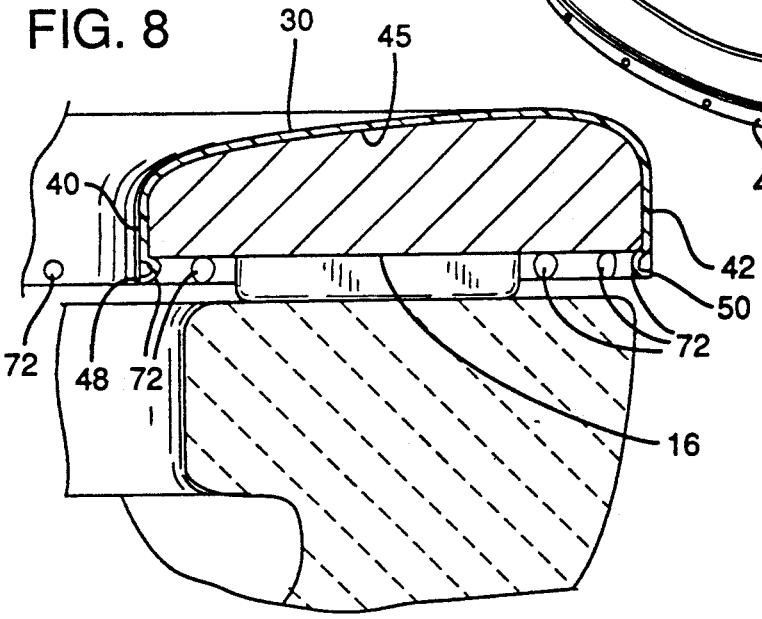
FIG. 8 is a cross-sectional view as in FIG. 3, on an enlarged scale, taken along line 8—8 of FIG. 7.

FIGS. 7 and 8 show another alternative embodiment of the replaceable toilet seat cover of the present invention. Cover 10 is the same as the first embodiment, with the exception of the engaging surfaces on the sides 40, 42. Instead of continuous beads, the embodiment of FIGS. 7 and 8 includes one or more inwardly-extending protuberances 72 for contacting and engaging toilet seat 12 to retain the cover body 30 on the seat. The plurality of protuberances 72, which extend inwardly into the concave channel 45 on the inside of body 30, hold the cover firmly in place by engaging the underside 16 of the seat in a manner similar to beads 52, 54.

Figure 9:
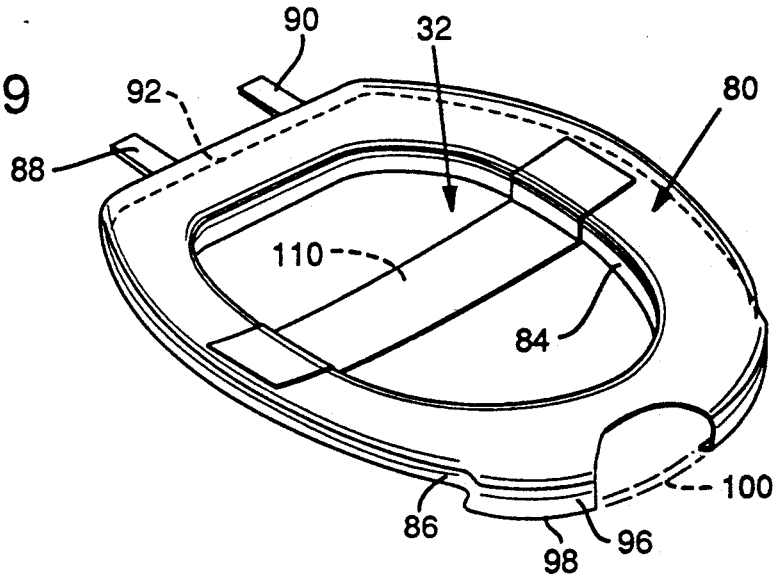
FIG. 9 is a perspective view of another alternative embodiment of the protective seat cover as in FIG. 1, additionally including a paper tear-off barrier extending across the central opening of the cover.
Figure 10:
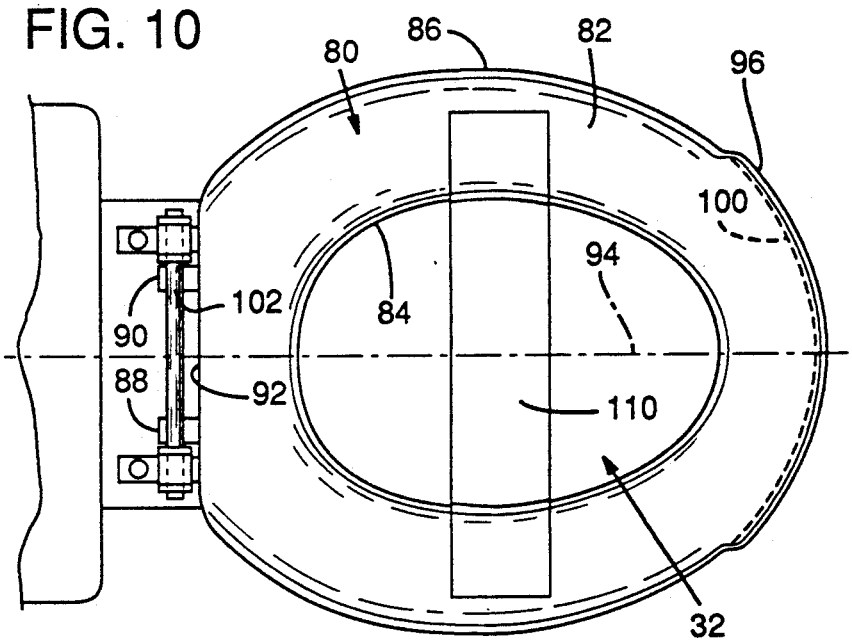
FIG. 10 is a top plan view on an enlarged scale of the embodiment of FIG. 9.

Another embodiment of the toilet seat cover is shown in FIGS. 9 and 10. In this embodiment, the seat cover body 80 is formed in the same manner as the first embodiment cover and includes a broad, curved top surface 82 and inner and outer side portions 84, 86. Unlike the first embodiment, however, inner and outer sides 84, 86, respectively, depend a shorter distance from the top surface and do not include beads or other engaging surfaces along the entire length of each side. Instead, the sides 84, 86 only serve to cover portions of the inner and outer sides of the toilet seat. To engage and retain cover 80 on a toilet seat, a pair of tabs 88, 90 are attached and extend outwardly from a portion of the rear outside wall 92, which forms a part of encircling outer wall 86. Tabs 88, 90 extend generally parallel to the long axis 94 of the generally oval-shaped cover 80. Long axis 94 extends through the center line of cover 80, as shown in FIG. 10.

On the front end of cover 80, opposite to back side 92 where tabs 88, 90 are formed, is a retaining edge or engaging surface 96, which forms part of outer side 86. Retaining edge portion 96 has a lower edge 98 which extends below the lower edge of outer side 86. Adjacent lower edge 98 is a bead of resilient material 100, like beads 52, 54 in FIG. 3. Bead 100 engages the underside of a toilet seat (not shown).

FIG. 10 illustrates how the embodiment of FIGS. 9 and 10 is attached to a toilet seat. Tabs 88, 90 are inserted beneath a hinge mechanism 102 found on certain types of toilets. The tabs hold the rear side of cover 80 on the seat (not shown). Bead 100 extends slightly beneath the underside of the toilet seat in the manner of beads 52, 54 shown in FIG. 3 and retain the front of cover 80 on the seat. Together, tabs 88, 90 and bead 100 retain body 80 on the toilet seat.

The embodiment of FIGS. 9 and 10 also illustrate an alternative or additional device for ensuring that the replaceable seat cover of the present invention has not be previously used. A tear-off ribbon 110 attached to the top surface 82 of the cover extends across central opening 32. Ribbon 110 is preferably formed of paper and is attached to the top of cover 82 by adhesive or the like. It serves as a tear-off barrier to obstruct central opening 32 until the cover is used. Tear-off ribbon 110 can be used in all embodiments of the invention to help ensure that the cover has not been previously used. In the embodiment of FIGS. 5 and 6, the tear-off ribbon can be adhesively attached to the protective film 66 and can be employed to help remove the film.

Figure 11:
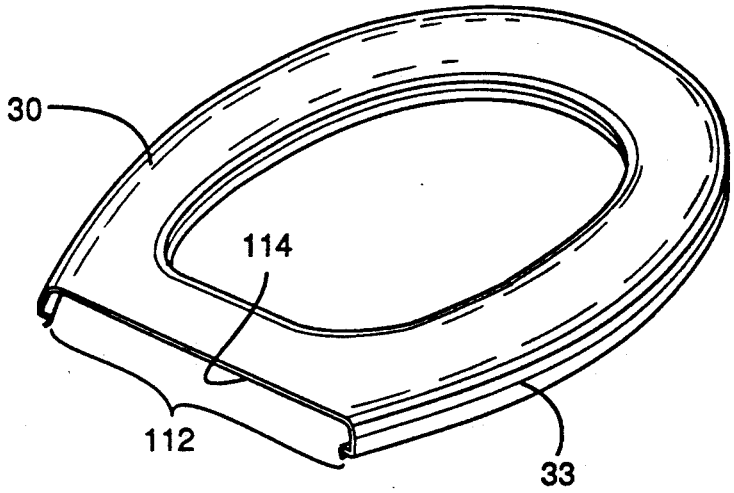
FIG. 11 is a partial, perspective view of the back side of a toilet seat illustrating another alternative embodiment of the invention.

The hinge mounting for the toilet seat shown in FIG. 10 represents only one type of toilet seat attachment system available on the market. Some toilet seats incorporate a hinge and cove molded into and integral with the back edge of the seat. In order to accommodate such an attachment system, the toilet seat cover of the present invention can include a "open" backside, as shown in FIG. 11. In this embodiment, the body 30 of the toilet seat cover includes a discontinuous depending outer side wall 33 which extends around the front and sides of the cover but is removed from the back wall of the cover. The open or removed portion 112 of side wall 33 allows the cover to be used on toilet seats which have attaching hinges protruding through or attached to the top surface of the toilet seat. In the embodiment of FIG. 11, the back edge 114 marks the limit of coverage of the toilet seat by cover body 30. The opening 112 at the back of the cover provides clearance for hinges or other attaching devices which might protrude or otherwise interfere with the cover 30.

The replaceable toilet seat cover of the present invention is an inexpensive, convenient means for insuring that guests are provided with a sanitary toilet seat cover without the need to use disposable paper covers. The cover of the present invention can remain in place for several days, in appropriate circumstances, providing assurance of a personal seat cover without the inconvenience of installing a disposable cover each time the toilet is used. It is particularly useful for hotels and motels and other guest accommodations where one party will make use of a private bathroom throughout their stay. If the embodiments providing for a removable protective film or tear-off strip are provided, the user is assured at a glance that the cover installed on the toilet seat has not been previously used. Each seat cover is lightweight, weighing between about 2-ounces and 4-ounces. A bundle of the covers, suitably packaged for dispensing and carrying, is light and easy to handle. Because the covers can be stored in nested fashion, provision for ten or more replaceable covers can be made in a space several inches in depth. Likewise, storage of used toilet seat covers requires little room, encouraging accumulation for recycling. The thermoplastic material from which the covers are made is readily recyclable and it is anticipated that a large proportion of the covers would be collected and recycled, further reducing the overall cost of their use.

Alternative embodiments of the replaceable toilet seat cover are possible within the scope of the present invention. For example, toilet seats are made in many shapes and sizes and covers can be fabricated to accommodate virtually any seat shape or configuration. Although an oval-shaped seat is shown in the illustrative embodiments, the invention could readily be employed on horseshoe-shaped seats found most often in institutional and public bathroom facilities. The cover is intended to extend generally around the central opening of the seat, but it is not required that either the cover or the seat completely enclose the central opening. Covers can be made for toilet seats of various thicknesses, depths and dimensions, with the covers generally being fabricated to correspond closely to the shape and size of each particular toilet seat to provide a tight, close fit. Although the preferred embodiment of the invention shown in the figures generally covers most of the side walls of the toilet seat, an alternative embodiment of the cover might extend along only portions of the side walls.

The type of engaging surfaces used to attach and hold the cover on a toilet seat is a matter of design choice and other engaging surfaces will occur to those skilled in the art within the scope of the invention. For example, discontinuous short segments of bead might be provided adjacent the inner and outer edges of the cover. A length of bead on just the inner or the outer edge might also be sufficient to hold the cover in place on certain types of toilet seats. Alternative engaging surfaces such as adhesives or the like may be employed to retain the cover on the seat temporarily during usage. Although the embodiment of FIGS. 5 and 6 provides for a peel-off protective film o the outside surface of cover 30, extending over top 35, sides 40, 42 and curved sections 38, 44 of the cover, a similar protective film could also be applied on the inside surface of the cover, within channel 45. Such a protective film on the inside surface could be selectively removable using adhesive tabs in the same manner as the outside film described in connection with the embodiment of FIGS. 5 and 6. The type of thin moldable resilient sheet material used to form the body of the toilet seat cover can vary from the examples of plastic or paper products described above. Toilet seat covers formed of clear, milky or dark plastics could be used, for example. Other alternative embodiments will occur to those skilled in the art.

The invention provides a semi-rigid, replaceable toilet seat cover formed from a sheet of thin, moldable or formable material designed to provide a hygienic toilet seat surface for guests. One embodiment of the invention provides a replaceable toilet seat cover with a protective film on its surface for the user to peel off before using the toilet seat, ensuring that a clean, unused seat has been provided. In addition, the invention provides a replaceable toilet seat cover which is sufficiently resiliently deformable to permit a plurality of the toilet seat covers to stack together in nested fashion, facilitating storage and dispensing of the covers, and helping in the storage and recovery of used covers.

What is claimed is:

1. A replaceable cover adapted to fit over the seating surface of a toilet seat, the cover comprising:

a semi-rigid annular body formed of a sheet of thin moldable resilient material, said body extending around a central opening and having inner and outer edges which extend continuously around said body wherein said inner edge is adjacent said central opening, said body having a contoured top surface which includes continuous inner and outer downwardly-depending sides, said inner side curving inwardly and downwardly into said central opening to said inner edge of said body and outer side curving outwardly and downwardly to said outer edge of said body to produce a contoured shape which generally corresponds to the shape of the seating surface of a toilet seat over which the cover is adapted to fit, and a continuous elongated bead of said resilient material formed on said outer side of said body adjacent said outer edge and extending continuously around said outer side and adapted to engage a toilet seat to retain said body thereon.

2. A toilet seat cover as in claim 1 in which said depending sides are resiliently deformable outwardly away from one another sufficiently to permit a plurality of said bodies to stack together in nested fashion.

3. A toilet seat cover as in claim 1 in which said body is vacuum-formed of thermoplastic sheet material.

4. A toilet seat cover as in claim 1 in which said sheet of thin moldable resilient material has a thickness in the range of between about 10-mils and 20-mils.

5. A cover as in claim 1 including a protective film of flexible sheet material covering said body, said protective film being removable from said body.

6. A cover as in claim 5 in which said body includes an inside surface which faces and contacts the toilet seat and an outside surface opposite said inside surface, and said protective film covers the outside surface of said body.

7. A cover as in claim 5 in which said protective film has a thickness in the range of between about 0.5-mils and 6-mils.

8. A cover as in claim 5 in which said protective film includes a tab adhesively attached thereto to facilitate removal of said protective film from said body.

9. A toilet seat cover as in claim 1 further including a continuous elongate bead of said resilient material formed along said inner side of said body adjacent said inner edge for retaining said body on a toilet seat.

10. A toilet seat cover as in claim 9 including a single seat-engaging bead of said resilient material formed on said outer side of said body extending along substantially the full length of said outer edge together with a single seat-engaging bead of said resilient material formed on said inner side of said body extending along substantially the full length of said inner edge.

11. A toilet seat cover as in claim 1 including a tear-off barrier extending across said central opening, said tear-off barrier being in the form of an elongate ribbon of paper attached to said body and extending across said central opening.

* * * * *